US007484922B2

(12) United States Patent
Harsch et al.

(10) Patent No.: US 7,484,922 B2
(45) Date of Patent: Feb. 3, 2009

(54) ARTICULATED ARM TRANSPORT DEVICE

(75) Inventors: Erich Harsch, Weingarten (DE); Rainer Reichenbach, Schlier (DE)

(73) Assignee: Mueller Weingarten AG, Weingarten (DE)

( * ) Notice: Subject to any disclaimer, the term of this patent is extended or adjusted under 35 U.S.C. 154(b) by 241 days.

(21) Appl. No.: 10/579,283

(22) PCT Filed: Nov. 11, 2004

(86) PCT No.: PCT/DE2004/002492

§ 371 (c)(1),
(2), (4) Date: Jun. 21, 2006

(87) PCT Pub. No.: WO2005/046907

PCT Pub. Date: May 26, 2005

(65) Prior Publication Data

US 2007/0077135 A1 Apr. 5, 2007

(30) Foreign Application Priority Data

Nov. 13, 2003 (DE) ..... 103 52 982

(51) Int. Cl.
*B65G 65/00* (2006.01)

(52) U.S. Cl. ..... 414/749.1; 72/405.09; 100/207; 198/468.2

(58) Field of Classification Search ..... 414/749.1; 198/468.2; 100/207; 901/6, 15; 72/405.09, 72/405.1, 405.11, 405.12
See application file for complete search history.

(56) References Cited

U.S. PATENT DOCUMENTS 1,835,579 A 12/1931 Westin
4,056,198 A 11/1977 Boserup
4,065,001 A 12/1977 Ohnaka
4,661,040 A 4/1987 Cigna
5,106,258 A 4/1992 Orii
5,452,981 A * 9/1995 Crorey et al. ..... 198/468.6
5,584,205 A 12/1996 Harsch et al.
6,712,198 B2 3/2004 Harsch et al.
6,715,981 B1 4/2004 Harsch et al.
6,968,725 B2 11/2005 Harsch et al.
2001/0014279 A1* 8/2001 Harsch et al. ..... 414/749.1
2004/0261488 A1 12/2004 Lauke et al.

FOREIGN PATENT DOCUMENTS

DE 26 28 734 12/1977
DE 28 02 738 7/1979

(Continued)

*Primary Examiner*—Donald Underwood
(74) *Attorney, Agent, or Firm*—Jordan and Hamburg LLP

(57) ABSTRACT

The invention relates to an articulated arm transport device which is especially provided for the automation of large component transfer presses. Said articulated arm transport device is characterized by a kinematics and design that do not require any additional clearance between the press rams and pillars and that permit an introduction or extraction of workpieces even with a small clearance between the upper and lower tool. The articulated arm transport device is mounted above the workpiece transport plane on the press stands. The articulated arm part linked with the cross-member is shorter than the articulated arm part and makes a pivoting movement substantially above the common pivot. A lifting and/or pivoting movement can be carried out by means of controlled lift drives that are functionally linked with transmission means.

4 Claims, 3 Drawing Sheets

FOREIGN PATENT DOCUMENTS

| | | |
|---|---|---|
| DE | 35 25 988 | 1/1987 |
| DE | 100 42 991 | 3/2002 |
| EP | 0 114 774 | 8/1984 |
| EP | 0 435 417 | 7/1991 |
| EP | 0 672 480 | 9/1995 |
| EP | 0 693 334 | 1/1996 |
| EP | 1 129 800 | 9/2001 |
| EP | 1 161 317 | 12/2001 |
| FR | 2 346 071 | 10/1977 |
| WO | WO- 00/54904 | 9/2000 |

* cited by examiner

ARTICULATED ARM TRANSPORT DEVICE

BACKGROUND OF THE INVENTION

The invention relates to a transport apparatus for transporting workpieces from one machining station to the subsequent machining station of a press, press line, simulator, or the like.

Where the manufacture of a workpiece calls for a plurality of work operations, such as cutting or shaping, then for economic production the necessary individual operations are carried out in a transfer press or press line, as they are known. The number of tools then corresponds to the number of work stages that are necessary for the manufacture. In the presses there are transport devices with which the workpieces are transported from one workstation to the next.

In the case of transfer presses or large-component transfer presses, the transport devices comprise gripper or load-bearing rails that extend through the entire length of the shaping machine. In order to transport the workpieces, the load-bearing rails are fitted with gripper or holding elements. In this case, a distinction is made, depending on the movement sequence, between a two-axis transfer fitted with suction crossmembers or a three-axis transfer fitted with gripper elements.

As an additional movement, pivoting in order to change the attitude of the component during the transport step may be required. This attitude change can also occur using an orientation station arranged between the shaping stages.

The transfer movement is initiated via cams that are forcibly synchronized with the ram drive via movement transmission elements. The manufacture of large-area components, in particular, has led to the development of large-component transfer presses of greater and greater dimensions, based on the shaping force and the transport paths. Tool spacings on the order of magnitude of 5000 mm are entirely normal nowadays, and therefore corresponding transport steps are also necessary.

As a result of this development, the masses to be accelerated and braked in the transfer systems are completely opposed to the low masses of the components to be transported. Since the transport step is to be executed in an extremely short time, in order to achieve the greatest possible number of press strokes and therefore output of components, the system must have a high speed and therefore also acceleration and retardation.

A further disadvantage is the rigid movement sequence which is predefined by the cam drives. The optimum utilization of the free spaces between the lower and upper tool during the ram stroke to transport the parts is not possible.

In order to avoid these indicated disadvantages, current new developments concern replacing the previous transfer system with a corresponding number of transfer systems arranged between the machining stages and equipped with discrete drives. Such an arrangement is disclosed in EP 0 672 480 B1. Transfer systems arranged on the uprights are equipped with a number of drives that, mechanically linked to the movement transmission means, transport the components. As a special feature, the system can be re-equipped both as a two-axis transfer with suction beams and as a three-axis transfer with grippers. However, this universal use requires corresponding structural complexity.

A transfer device disclosed in DE 100 42 991 A1 is also arranged in each upright area. The transport apparatus is embodied as an articulated arm and is thus designed such that favorable clearances are possible relative to the ram movement. The articulated arm can thus move between upper and lower tool with a relatively small opening stroke of the press ram carrying the upper tool for removing the part.

Disadvantageous in this arrangement is the space required for avoiding a collision between the ram and the transfer apparatus. In the prior art, a free space is required between the upright and the ram so that the transport apparatus can execute the pivot movement. This leads to pressing the larger dimensions transverse to the part transport direction required.

The object of the invention is to further develop an articulated arm transport apparatus such that no additional space is required for the articulated arm transport apparatus between the upright and the ram.

SUMMARY OF THE INVENTION

The basic idea behind the invention is to modify the movement sequence of the articulated arm transport apparatus such that an adequate, in particular vertical, distance to the ram is provided. The geometry of the articulated arm parts is also changed and it is no longer executed in the same length, but rather the front articulated arm part to which the transverse crossmember is attached to the parts holding means is preferably shorter, which further improves the clearance. In addition, the articulated arm transport apparatus has an advantageous effect in the upright area and above the workpiece transport plane.

The articulated arm transport apparatus is mounted to the press uprights above the component transport plane. The first articulated arm part is dimensioned such that overlapping with the ram is not possible until there is a relatively large pivoting angle. Due to the ram movement, it is then situated in the area of its upper dead center, however, which reliably prevents a collision. The forward articulated arm part performs a pivoting movement directed upward relative to the point of rotation of the articulated arm parts. The first articulated arm part is pivotably borne on a carriage for performing a vertical lifting movement during the workpiece transport. The overlapping movement of the two articulated arm parts in connection with the vertical lift axis enables a freely programmable travel curve profile in a large band width, both for the component transport and for the unproductive movement. The unproductive movement can thus realize a very flat and therefore, relative to the clearance, extremely favorable travel curve. Thus it is possible to move the articulated arm into the free space that forms between upper and lower tool in an advantageous manner with a relatively small opening stroke of the press ram. The sequence results in less time for the component transport and leads to an increase in the press system's efficiency. Because of the dynamic lift axis, the articulated arm apparatus can be operated without additional structural measures, even at very different tool heights.

The entire transport apparatus comprises two articulated arm transport apparatuses that are arranged in the upright area in a mirror-image of one another and that are joined to one another via a transverse crossmember. The transverse crossmember is coupled to the front end of the shorter articulated arm part and carries the actual holding means for workpieces. Corresponding to the required functionality, the transverse crossmember can be provided additional degrees of freedom, such as pivoting in or counter to the direction of transport, an inclined position, or the ability of the holding means to traverse transverse to the part direction of transport, e.g. for dual parts. Each of the functions can be accomplished with a discrete drive on the transverse crossmember or by means of stationary drives via the articulated arm.

During the actual shaping process, the articulated arm transport apparatus is situated in a parked position in the upright area. The suggested design indicates a very favorable, narrow structure that is advantageous for the configuration of the press uprights. The latter can be dimensioned exclusively according to the strength required and do not require any additional width for the transport apparatus.

The movement transmission from the first to the second articulated arm part is accomplished via a fixed transmission. This enables a transmission adapted to the shaping stages and to the different tools, and thus enables a travel curve that is smooth and optimized in terms of movement.

Additional details and advantages of the invention result from the following description of an exemplary embodiment.

DETAILED DESCRIPTION OF THE INVENTION

Figure 1:
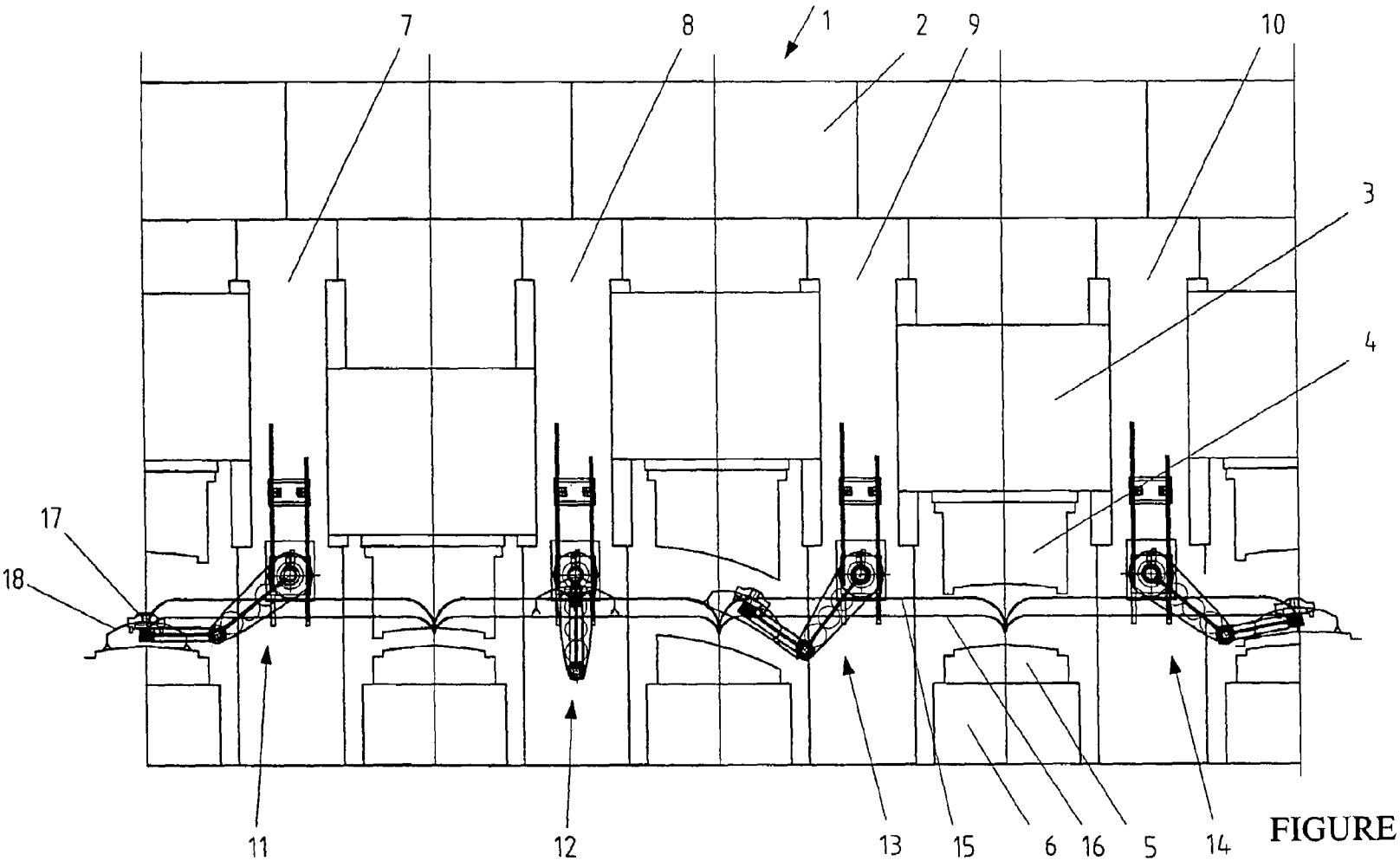
FIG. 1 illustrates the transfer press with articulated arm transport apparatus.

By way of example, FIG. 1 provides a segment of a transfer press 1. The headpiece 2 can be seen, as can the ram 3 with the upper tool 4 attached thereto. The lower tool 5 is clamped to the press table or sliding table 6. The inventive articulated arm transport apparatus 11-14 is attached to the press uprights 7 through 10 and depicted in different functions. The articulated arm transport apparatus 11 arranged on the press upright 7 illustrates removal of the shaped workpiece. The transport apparatus 12 allocated to press upright 8 is in the parked position during the shaping process. The transport apparatus 13 has removed a workpiece and is transporting the latter along the travel curve 15 to the next shaping step. Finally, the articulated arm transport apparatus 14 is placing the workpiece into a lower tool 5.

The arrangement of the articulated arm transport apparatus can be easily seen and is particularly advantageous for using the clearance between upper and lower tools. The movements of the transport apparatus do not interfere with the ram movement at all and thus the press does not have to be expanded to create a free space for the transport apparatus.

The travel curves 15 and 16 provide a visual illustration of the favorable relationships for very flat insertion, removal, and placement of the workpieces. The travel curve 16 illustrates the movement of the articulated arm without a workpiece. The travel curve 15 illustrates workpiece transport.

The articulated transport apparatus are each arranged on the press uprights by pair and in mirror image. The apparatus are joined via a transverse crossmember 17 to which the workpiece holding means 18 are attached.

Figure 2:
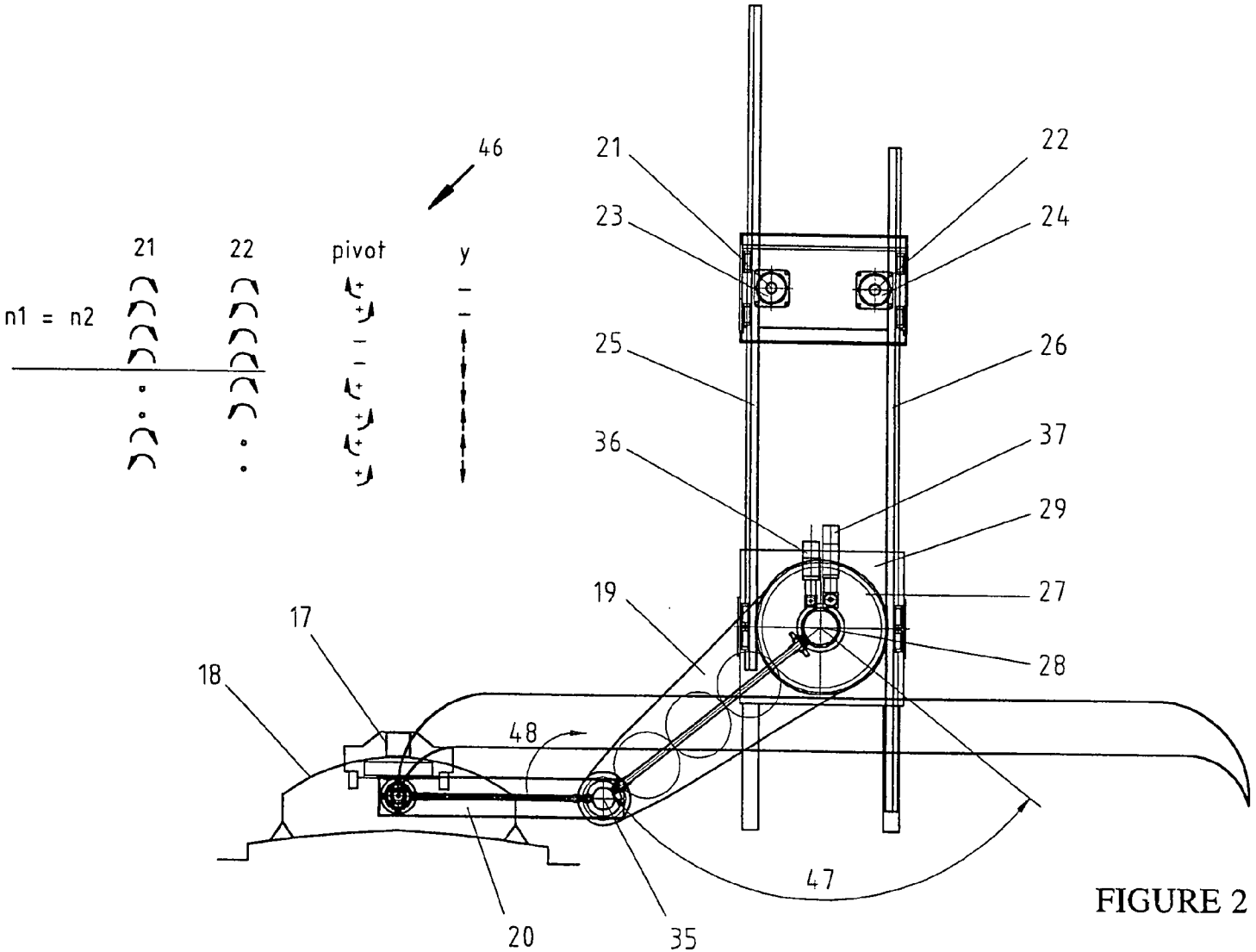
FIG. 2 is a detail of the drive for the articulated arm transport apparatus.

FIG. 2 provides a front elevation of the articulated arm transport apparatus. It comprises the articulated arm parts 19 and 20. Two drives 21 and 22 are provided for driving the two articulated arm parts, and they cause the toothed wheels 23 and 24 to rotate or keep them in a home position. These toothed wheels 23 and 24 act on the racks 25 and 26 such that the latter perform a corresponding vertical movement.

The parts of the racks 25 and 26 that are oriented downward act in concert on the toothed wheel 27. The articulated arm 19 is securely connected to a common center point of movement 28 with this toothed wheel 27.

The movement sequences for the articulated arm 19 can be seen in the table 46. However, the only movements illustrated are those that result, when driven, using the same number of rotations for the drives 21 and 22. For instance, when both drives 21 and 22 rotate to the right for the same number of rotations, this causes a rotation of the toothed wheel 27 to the right via the drive train 23, 24, 25, 26 and thus also a pivoting movement to the right along a pivoting angle 47 by the articulated arm 19 connected to the toothed wheel 27. In this case, no movement takes place in the vertical (Y-) axis. Overlapping movement, i.e., pivoting and vertical movement, is attained e.g. when the drive 21 idles and the drive 22 rotates. As can be seen from the table 46, any desired travel curve in a plane can be attained using the appropriate rotation or idling of only the drives 21 and 22. Large transport paths can be executed with no problem with the suggested articulated arm transport apparatus. The identical movement sequences can also naturally be attained with other drive components. For instance, if the toothed wheels 23 and 24 and the racks 25 and 26 are replaced with separately driven toothed belts with corresponding toothed belt pulleys, the exact same movements can be traveled.

Figure 3:
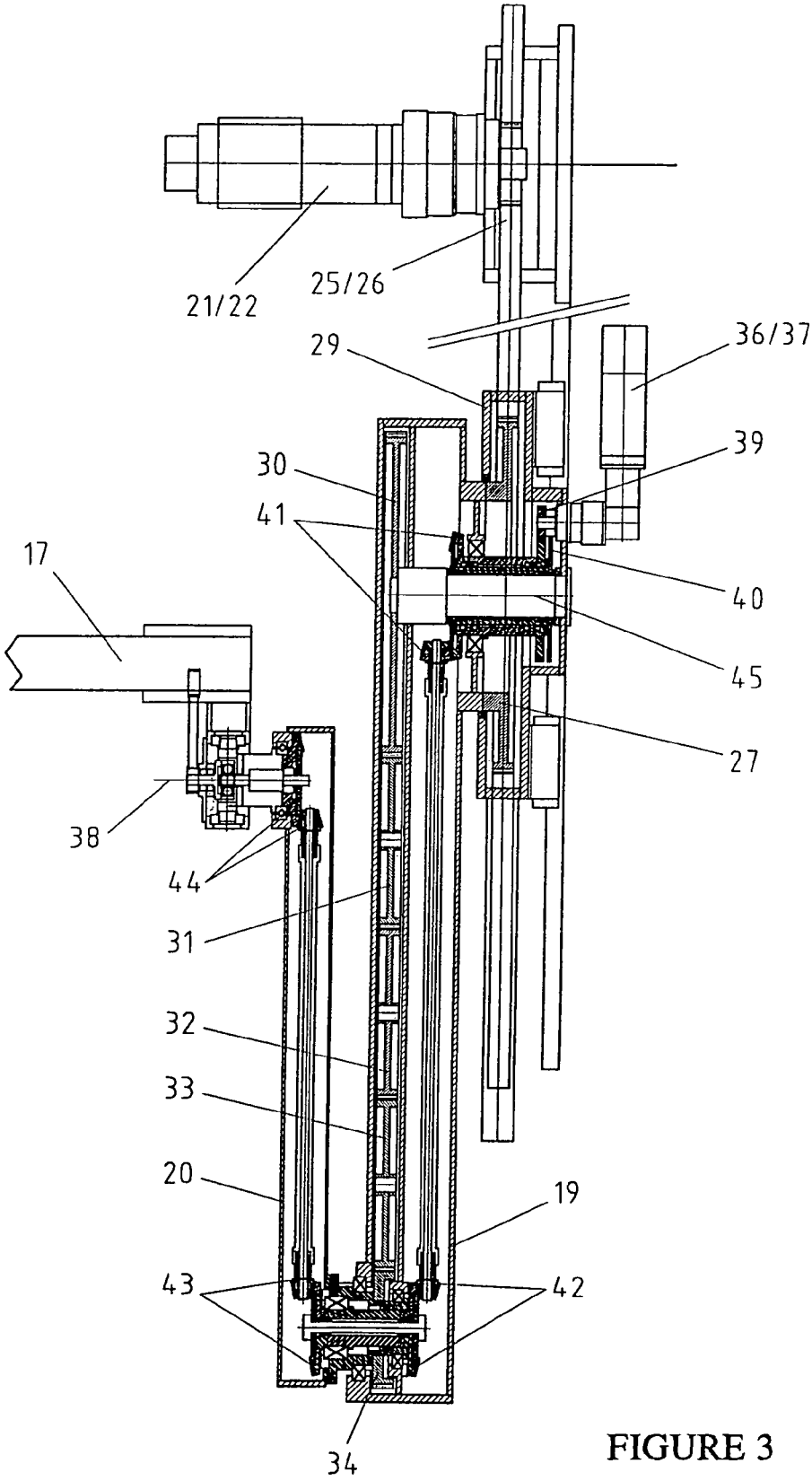
FIG. 3 is as for FIG. 2, but in a sectional representation.

FIG. 3 illustrates how the first articulated arm part 19 forwards the pivoting movement to the second articulated arm part 20. The toothed wheel 30, which is situated in the first articulated arm part 19, is connected to the carriage 29 via the axis 45. The toothed wheel 30 is mechanically linked to the toothed wheels 31 through 34. The toothed wheel 34 is securely joined to the second articulated arm part 20. If a pivoting movement of the first articulated arm part 19 is introduced via the drive chain 23, 24, 25, 26, this generates a rolling rotational movement of the toothed wheels 31, 32, 33, 34 and, due to the secure connection to the toothed wheel 34, the corresponding pivoting of the second articulated arm 20 along a pivoting angle 48 about the axis of rotation 35.

For the pivoting movement of the transverse crossmember 17 about the axis 38, a pinion gear 39 attached to the drive 36 drives the toothed wheel 40, which forwards the movement to the bevel gears 41 through 44.

Drive 37 can perform a potentially necessary moving apart of the workpiece holding means 18 for dual parts via a second system of bevel gears that are borne in the hollow shafts of the bevel gears 41 through 43 for the pivoting.

The invention is not limited to the described and illustrated exemplary embodiment.

| Legend | |
|---|---|
| 1 | Transfer press |
| 2 | Headpiece |
| 3 | Ram |
| 4 | Upper tool |
| 5 | Lower tool |
| 6 | Sliding table |
| 7 | Press upright |
| 8 | Press upright |
| 9 | Press upright |
| 10 | Press upright |
| 11 | Articulated arm transport apparatus |
| 12 | Articulated arm transport apparatus |
| 13 | Articulated arm transport apparatus |
| 14 | Articulated arm transport apparatus |
| 15 | Travel curve with workpiece |
| 16 | Travel curve without workpiece |
| 17 | Transverse crossmember |
| 18 | Workpiece holding means |
| 19 | Articulated arm part |
| 20 | Articulated arm part |
| 21 | Drive |
| 22 | Drive |
| 23 | Toothed wheel |
| 24 | Toothed wheel |
| 25 | Rack |

-continued

| Legend | |
|---|---|
| 26 | Rack |
| 27 | Toothed wheel |
| 28 | Point of rotation |
| 29 | Carriage |
| 30 | Toothed wheel |
| 31 | Toothed wheel |
| 32 | Toothed wheel |
| 33 | Toothed wheel |
| 34 | Toothed wheel |
| 35 | Point of rotation |
| 36 | Drive |
| 37 | Drive |
| 38 | Axis of rotation |
| 39 | Toothed wheel |
| 40 | Toothed wheel |
| 41 | Bevel gear |
| 42 | Bevel gear |
| 43 | Bevel gear |
| 44 | Bevel gear |
| 45 | Axis |
| 46 | Movement table |
| 47 | Pivoting angle |
| 48 | Pivoting angle |

The invention claimed is:

1. Apparatus for transporting workpieces in a press, press-line, large component transfer press or simulator comprising at least one machining station and a respective upright member alongside each machining station, the workpieces being transported in a workpiece transport plane in a workpiece transport direction which carries the workpieces sequentially to, into and away from a machining station, each said transporting apparatus being vertically displaceably mounted on a respective one of said upright members, the transporting apparatus comprising an articulated arm comprising first and second arm parts, the first arm part having a first end at which the first arm part is pivotably mounted for pivoting about a first axis perpendicular to the transport direction and parallel to and above the transport plane, and a second end, the second arm part being shorter than the first arm part and having a first end and a second end, the first end being pivotably mounted on the second end of the first arm part for pivoting about a second axis perpendicular to the transport direction and parallel to and below the transport plane with the second end of the second arm part above the transport plane;

a cross member mounted at the second end of the second arm part and extending transversely of the transport direction;

a regulatable lift device operatively connected to the articulated arm for moving the articulated arm vertically on the upright member, wherein the regulatable lift device comprises a carriage at which the pivotable mounting of the first arm part at the first end thereof is located, a pair of parallel vertical racks to which the carriage is operatively connected, two pinions each engaging a respective one of the racks, and two motors each connected to a respective one of the pinions for rotationally driving the pinions; and a toothed wheel rotatably mounted on the arm and wherein the racks engage the toothed wheel at diametrically opposed locations on the toothed wheel, whereby driving of the pinions in unison and/or selectively results in vertical movement and/or pivoting movements of the arm.

2. Apparatus according to claim 1, wherein the first arm part pivots about the first axis by a first angle;

the second arm part pivots about the second axis by a second angle; and the first angle is smaller than the second angle by a fixed ratio.

3. Apparatus according to claim 1, further comprising a workpiece holder connected to the cross member, the cross member together with the workpiece holder being pivotably mounted at the second end of the second arm part, a first regulatable drive, and a transmission connecting the first regulatable drive to the cross member thereby to pivot the cross member together with the workpiece holder about an axis parallel to the transport plane and perpendicular to the transport direction.

4. Apparatus according to claim 3, further comprising a second regulatable drive for changing attitude of the workpiece holder.

* * * * *